US006406341B1

(12) United States Patent
Morejohn

(10) Patent No.: US 6,406,341 B1
(45) Date of Patent: Jun. 18, 2002

(54) SHALLOW DRAFT BOAT

(75) Inventor: Christopher S. Morejohn, Titusville, FL (US)

(73) Assignee: Hell's Bay Boat Works Co., Titusville, FL (US)

( * ) Notice: Subject to any disclaimer, the term of this patent is extended or adjusted under 35 U.S.C. 154(b) by 0 days.

(21) Appl. No.: 09/718,108

(22) Filed: Nov. 20, 2000

(51) Int. Cl.[7] ..... B63H 5/16
(52) U.S. Cl. ..... 440/69; 114/288
(58) Field of Search ..... 114/288, 289, 114/290, 291; 440/68, 69

(56) References Cited

U.S. PATENT DOCUMENTS

| | | | | |
|---|---|---|---|---|
| 3,289,623 | A | | 12/1966 | Gray et al. |
| 3,937,173 | A | | 2/1976 | Stuart |
| 4,091,761 | A | | 5/1978 | Fehn |
| 4,392,448 | A | | 7/1983 | Shirley |
| 4,652,245 | A | | 3/1987 | May |
| 4,685,889 | A | | 8/1987 | Nystrom |
| 4,689,026 | A | | 8/1987 | Small |
| 4,713,028 | A | | 12/1987 | Duff |
| RE33,165 | E | | 2/1990 | Whitehead |
| 4,907,520 | A | | 3/1990 | Pipkorn |
| 4,915,668 | A | | 4/1990 | Hardy |
| 4,951,591 | A | | 8/1990 | Coles |
| 4,977,845 | A | | 12/1990 | Rundquist |
| 5,111,767 | A | * | 5/1992 | Haines ..... 114/288 |
| D334,011 | S | | 3/1993 | Biel et al. |
| 5,191,849 | A | | 3/1993 | Labrucherie et al. |
| 5,249,994 | A | | 10/1993 | Finkl |
| 5,350,327 | A | | 9/1994 | Self et al. |
| 5,474,014 | A | | 12/1995 | Russell |
| D367,462 | S | | 2/1996 | Lorenzen |
| 5,497,722 | A | | 3/1996 | English, Sr. |
| 5,570,650 | A | | 11/1996 | Harley |
| 5,833,502 | A | | 11/1998 | Anderson |
| 6,058,873 | A | * | 5/2000 | Koyanagi ..... 114/291 |
| 6,125,781 | A | | 10/2000 | White |
| 6,260,503 | B1 | * | 7/2001 | Allison ..... 114/291 |

* cited by examiner

*Primary Examiner*—Stephen Avila
(74) *Attorney, Agent, or Firm*—Vickers, Daniels & Young

(57) ABSTRACT

A shallow draft sports boat for use in in-shore fishing has a tunnel in its bottom allowing one to place an outboard motor higher with respect to the hull of the boat than is conventional. The tunnel is relatively short with respect to the overall length of the boat, has a small volume and is provided with a recess at its leading end and a vent communicating between the recess and the port in the transom above the water line.

22 Claims, 3 Drawing Sheets

SHALLOW DRAFT BOAT

BACKGROUND OF THE INVENTION

This invention relates to recreational boats used in the sport of fishing and particularly to shallow draft boats adapted to be powered by outboard motors.

Fishing is a popular sport throughout the world. Fishing is often performed from boats near the shore or in other areas having shallows which attract fish. The boats used in pursuing this activity must perform several tasks in which various attributes are important.

The boat must get fishermen and fisherwomen to the place they wish to fish quickly and comfortably. This sometimes includes long passages over open water in which waves may be encountered. Stability and speed becomes important. In a small boat (about 16–22 feet), speed is obtained by causing the boat to ride on top of the water in what is often referred to as "planing" rather than in the water in the displacement mode. Adequate power and a proper hull shape are necessary for planing. Once at the location of fishing, shallow draft characteristics become more important. Reefs, sandbars, shallow flats, and various obstructions are common near the shore, in smaller lakes and rivers. A boat with a shallow draft may ride over a particular obstruction when a boat with a deeper draft will hit it and possibly suffer damage.

With fishing boats, a shallow draft is important in two different modes of operation. When the outboard motor is in a down position providing power to the boat, the outboard motor is often the lowest portion of the boat. Thus, the shallow draft with the outboard motor down is important to protect the motor from damage. When one is fishing, one often shuts the motor off and tilts the outboard motor into the up position. In this position, the outboard motor is entirely out of the water and the draft of the boat is now determined by the most downwardly extending portion on the boat hull. This is important to fishermen and fisherwomen as the boat may drift or is sometimes polled to move it quietly through shallow areas. A shallow draft boat can quietly pass over obstructions which would stop a deeper draft boat.

Obtaining good performance characteristics and good shallow draft characteristics both with the motor down and motor up is difficult. Design elements which help in one performance or draft area often appear to hurt in another performance or draft area. Thus, conventionally, high speed planing can be traditionally addressed with a flat bottom and the propeller portion of the outboard motor extending well below the flat bottom. Additionally, the hull must be designed and constructed in a manner which allows operation in rough sea conditions with waves coming from the bow, the stem or either side. Rough sea operation is sometimes addressed with a deep V hull shape. These design considerations sometimes increase the draft of a boat.

SUMMARY OF THE INVENTION

The present invention addresses high speed performance, low speed performance, motor down draft, and motor up draft concerns by providing a short tunnel in the hull allowing one to mount an outboard motor higher with respect to the bottom of the boat while still maintaining good performance and draft characteristics.

In accordance with the present invention, a boat hull is provided having a short tunnel in the stern of the boat allowing water to flow through the tunnel past the transom where it is acted upon by the propeller of an outboard motor which is mounted higher than in a conventional boat.

Still further in accordance with the invention, the tunnel is no longer than twenty percent (20%) of the overall length of the boat.

Yet further in accordance with the invention, a tunnel is provided in a boat hull having a recess at its forward end defined by a closed bottom wall and an open back wall, the recess communicating with a vent tube having its other end open above the water line of the boat hull.

Yet further in accordance with the invention, a boat hull is provided having a rear planing surface and a tunnel near the stem, the tunnel having a recess at its forward end and a vent tube connecting the recess to a port in the transom of the boat above the water line.

Yet further in accordance with the present invention, a short tunnel is provided at the stem of the boat having a planing surface, the tunnel being defined by planar walls.

The principal object of the present invention is to provide a boat with good operating characteristics both at low and high speed and with a shallow draft in both the motor down and motor up configurations.

It is another object of the present invention to provide a boat on which an outboard motor can be mounted higher in relation to the planing surface of the boat whereby the boat may be operated in relatively shallow water when the boat is in a plane configuration.

It is still another object of the present invention to provide a boat with a tunnel allowing the outboard motor to be higher than is conventional but still having good high speed characteristics both for traveling in a straight line and when turning, and good characteristics when operating in rough water both in oncoming and following seas.

It is still another object of the present invention to provide a boat having planar surfaces in the stem including planar surfaces in a central tunnel whereby the boat is more stable and less tippy than other designs.

It is yet another object of the present invention to provide a boat with a tunnel having a minimal volume whereby the buoyance lost at the stem caused by the tunnel is minimal.

It is yet another object of the present invention to provide a boat having a tunnel vent communicating with the forward portion of the tunnel allowing improved water flow through the tunnel and efficient operation of an outboard motor positioned at the rear of the tunnel.

It is another object of the present invention to provide a boat having a tunnel allowing improved operating characteristics and draft characteristics which is simple and inexpensive to manufacture and simple and inexpensive to maintain.

These and other objects and advantages of the present invention will become apparent from the following detailed description of a preferred embodiment thereof and from the accompanying drawings.

DESCRIPTION OF A PREFERRED EMBODIMENT

Figure 1:
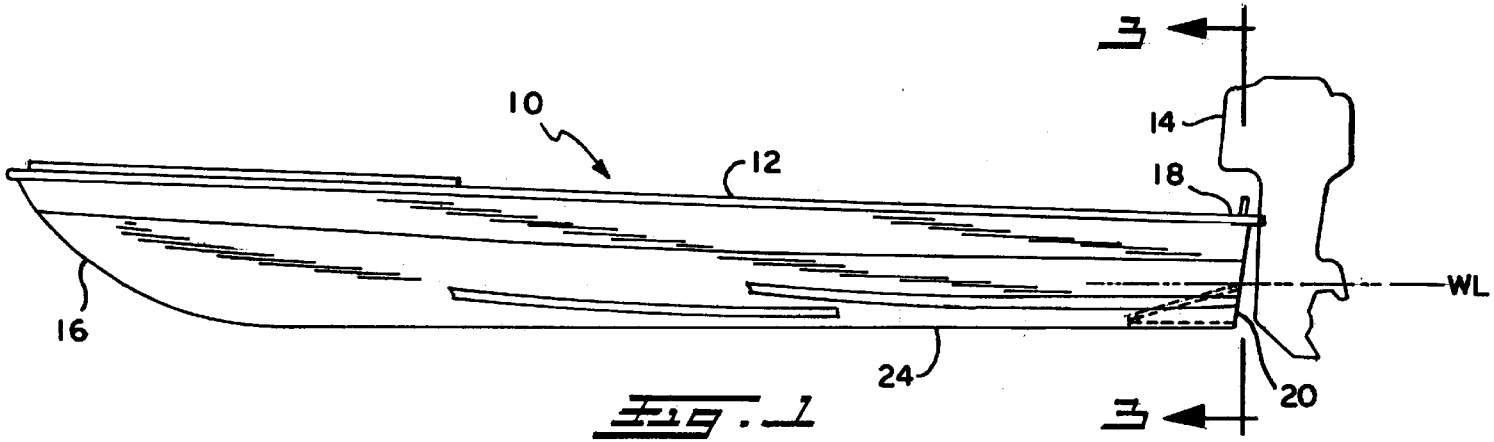
FIG. 1 is a side elevation view showing a boat in accordance with the present invention.

Referring now to the drawings, wherein the showings are made for the purposes of illustrating a preferred embodiment of the invention and not for the purpose of limiting same. FIG. 1 shows a boat 10 comprised of a hull 12 and an outboard motor 14. The boat 10 has a bow 16 and a stem 18. A transom 20 closes the stem end of the boat 10. As can be seen referring to FIGS. 1 and 2, the bow 16 of the boat hull 12 is somewhat sharp and V-shaped in cross section having a pointed V bottom 22. This is conventional. The rear area of the boat towards the stern has a flat bottom area 24. While many configurations of bottoms for boats are known in the art, one popular configuration includes a V shape forward area and a flat planar rear area. This allows the boat hull to "cut" through waves at the bow while also rising up on the water and planing at high speeds in the rear area. The flat rear area facilitates planing.

When a boat is at rest or operating at various slow speeds, it sits somewhat in the water. The boat floats in the water displacing an amount of water generally equal to its own weight thereby floating in equilibrium. When a boat operates at high speed, if the boat is planing, the boat no longer displaces an amount of water equal to its weight. Rather, the boat "planes" in a dynamic situation where the boat displaces less water than its total weight. This is facilitated by a flat planing surface.

Figure 3:
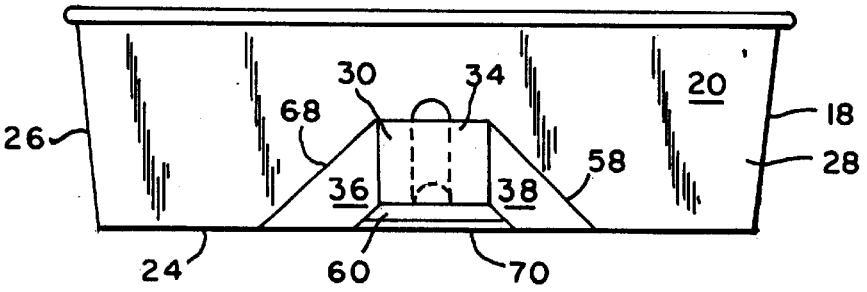
FIG. 3 is a rear plan view of the boat seen in FIGS. 1 and 2.

Referring now to FIG. 3, one sees the stem of the boat 18 closed by the transom 20. The transom extends between the left or port side of the boat 26 and right or starboard side of the boat 28. The left and right sides 26, 28 are relatively planar and meet the flat bottom portion 24 at a sharp angle.

Referring again to FIG. 3, a tunnel 30 has its rear end positioned in the center of the transom 20. The tunnel 30 is enlarged in the drawings for purposes of clarity. The tunnel is actually substantially smaller than illustrated in FIG. 3.

Figure 2:
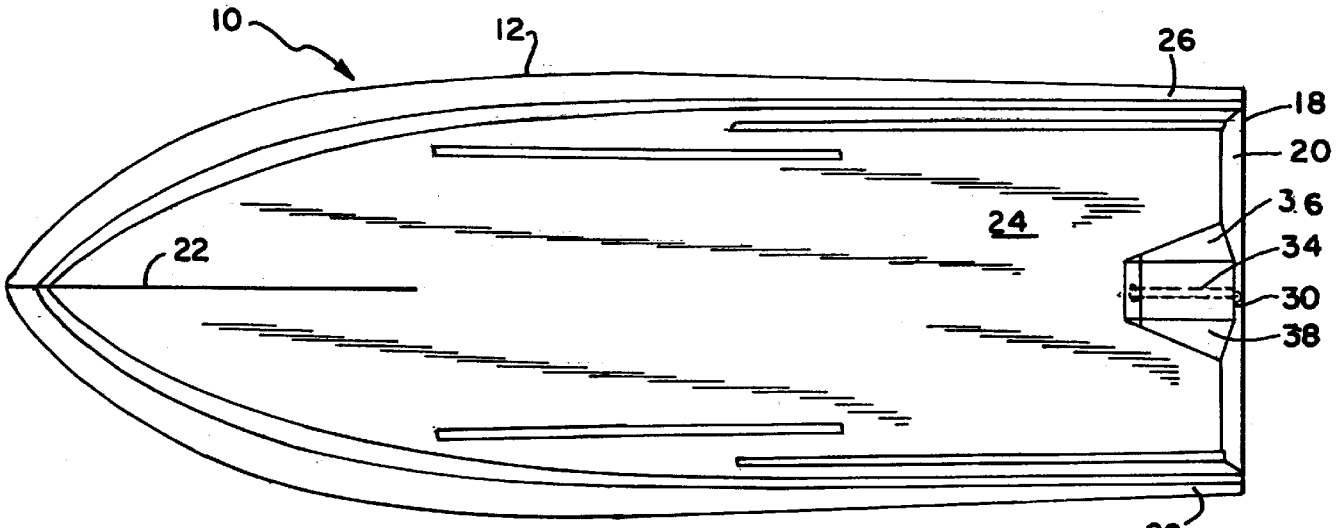
FIG. 2 is a bottom plan view of the boat seen in FIG. 1 without an outboard motor.
Figure 4:
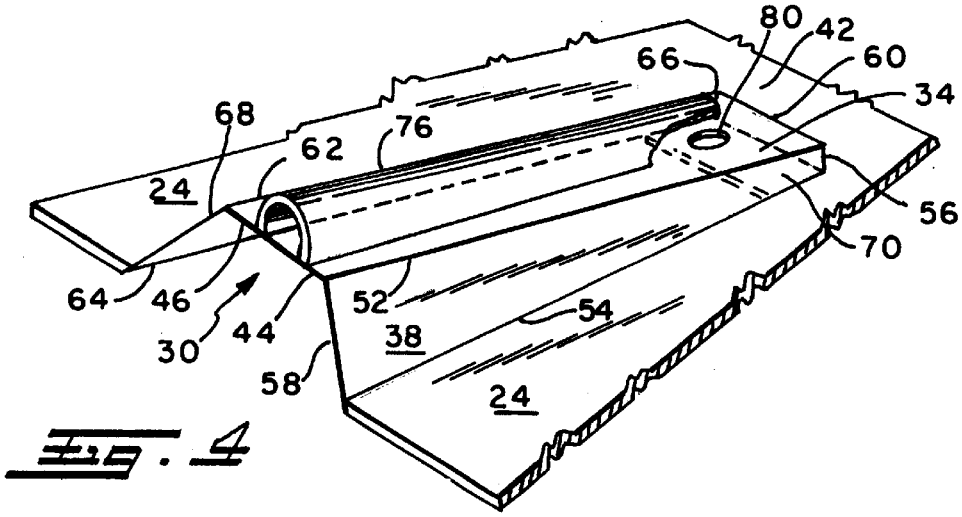
FIG. 4 is an enlarged pictorial partially cut away view of the tunnel and vent structure of the boat seen in FIGS. 1–3.

Referring to FIG. 2, the tunnel comprises a top wall 34, a left side wall 36 and a right side wall 38. Referring now to FIG. 4, the top wall 34 is generally rectangular having a uniform width over its entire length and a straight forward end 42 and a straight rearward end 44. The top wall 34 has a generally planar downwardly facing surface 46. The tunnel right side wall 38 is quadrilateral in shape and planar. The right side wall top edge 52 is straight and joins the right side of the tunnel top wall 38 along its entire length. The right side wall bottom edge 54 is straight and joins the flat bottom 24 of the boat hull along its entire length. The right side wall forward edge 56 is straight, relatively short and joins a tunnel forward wall 60. The right side wall rearward edge 58 is straight and joins the transom 20.

Figure 5:
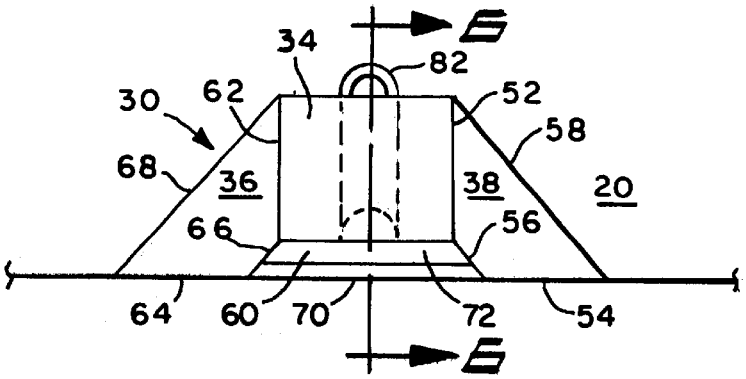
FIG. 5 is an enlarged view from the rear of the boat showing the tunnel seen in FIGS. 1–4; and, FIG. 6 is an enlarged side view, partially in cross section and partially cut away pictorially showing the operation of the tunnel and vent structure seen in FIGS. 1–5.

As can be best seen in FIG. 5, the left side wall 36 is the mirror image of the right side wall 38. The left side wall top edge 62 is straight and joins the top wall 34. The left side wall bottom edge 64 is straight and joins the flat bottom portion 24 of the boat. The left side wall forward edge 66 is straight and joins the tunnel forward wall 60. The left side wall rearward edge 68 is straight and joins the transom 20.

As described above, the forward ends of the top wall 34, the left side wall 36 and the right side wall 38 all join the tunnel forward wall 60 at their forward edges. Tunnel forward wall 60 is trapezoidal in shape with two side edges, a bottom edge and a top edge slightly shorter than the bottom edge.

The most forward portion of the tunnel 30 is closed by a bottom panel 70. The bottom panel 70 is trapezoidal in shape and closes the first few inches only of the bottom of the tunnel 30. Thus a small forward recess 72 is created enclosed by the forward wall 60, the top wall 34, the left side wall 36, the right side wall 38, and the bottom panel 70. Other than the portion closed by the bottom panel 70, the remainder of the tunnel 30 is completely open on the bottom. The tunnel 30 is also completely open at its rear end where the side walls 36, 38 and top wall 34 join the transom 20. The shape of the tunnel rearward opening is trapezoidal with the narrow parallel leg being at the top and the wide parallel leg at the bottom. The two side walls of the trapezoidal opening are formed by the rearward edges 58, 68 of the tunnel side walls 36, 38.

A semi-circular tube 76 is positioned along the center line of the upper surface of the top wall 34. The tube 76 is closed at its forward end. A hole 80 is provided near the forward end of the tunnel top wall 34. The hole 80 provides fluid communication between the forward recess 72 and the interior of the tube 76. The rear end of the tube 76 opens through the transom 20. As can be seen in FIG. 1, the rear opening 82 of the tube 76 is generally above the water line of the boat 10 when the boat is at rest. When the boat is underway, the rear opening 82 will generally remain above the top surface of the water upon which the boat is riding thereby communicating the recess 72 with the atmosphere and also providing some suction through reduced pressure created by the movement of the boat through the water along the transom.

The size and shape of the tunnel 30 is important. Dimensions for a tunnel appropriate for a 16–18 foot boat carrying a 25–40 horsepower outboard motor are as follows. The overall length of the tunnel measured from the transom to the tunnel forward wall 60 is approximately 26 inches (26"). The tunnel top wall 34 is five inches (5") wide over its entire length. The vertical distance from the rear end of the tunnel top wall 34 to the plane defined by the boat flat bottom 24 is five inches (5"). The forward tunnel wall 60 is five inches (5") wide at its top edge and only slightly wider at its bottom edge. Forward tunnel wall 60 is about one-half inch (½") high. The opening in the transom of the tunnel 30 is five inches (5") at the top corresponding to the width of the top wall 34 and fourteen inches (14") wide at the bottom. At the transom, the tunnel side walls 36, 38 converge from fourteen inches (14") apart at the bottom to five inches (5") apart at the top. The tunnel side wall bottom edges 54, 64 also converge toward one another becoming much closer to one another at the forward end of the tunnel than at the transom 20. The side wall bottom edges 54, 64 are about fourteen inches (14") apart at the transom and only slightly greater than five inches (5") apart at the tunnel forward wall 60. All of the tunnel surfaces are flat and planar. The edges where various surfaces intersect one another can be slightly rounded but are relatively sharp. This provides planing surfaces and stability surfaces which aid in high speed performance of the hull 12.

The overall volume of the tunnel 30 is only about three quarters (¾) of a cubic foot. The weight of water completely filling the tunnel is therefore somewhat less than 50 lbs. Thus, only a small amount of buoyance at the rear of the boat is sacrificed by inclusion of the tunnel 30.

Figure 6:
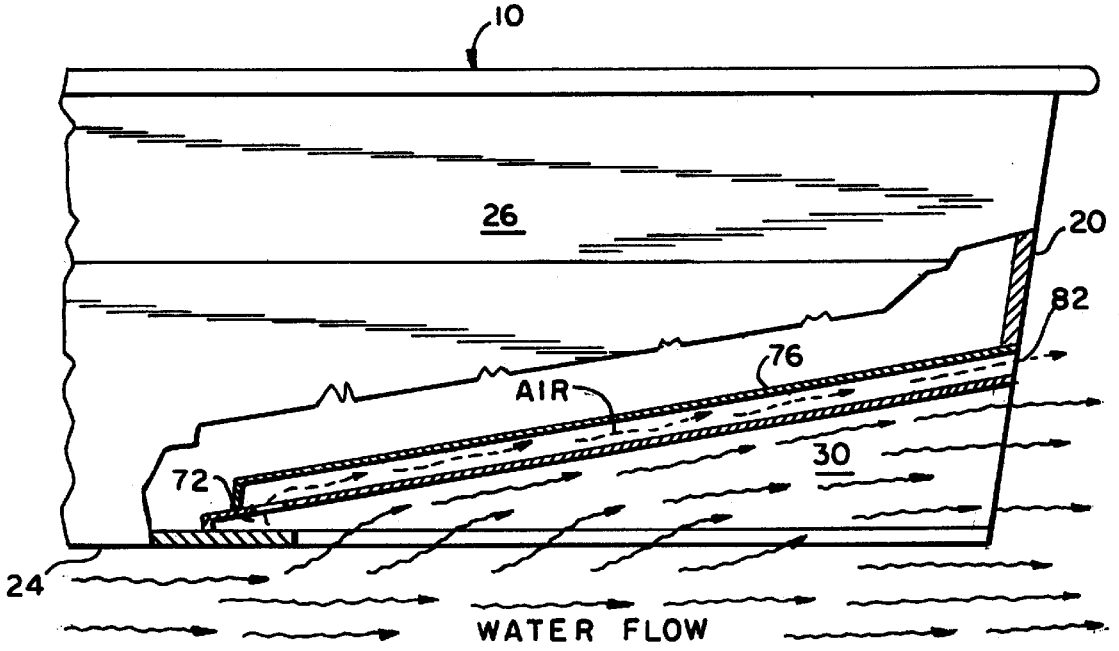

Operation of the tunnel while the boat is underway is illustrated in FIG. 6. When the boat 10 is moving forward through the water at a high rate of speed, the boat will be in planing mode and the flat bottom portion 24 will be riding on top of the water. Water and air streams along the bottom of the boat 10 and a portion of this flow enters the tunnel 30. The motion of the boat 10 forward at a high rate of speed creates reduced air pressure behind the transom 20. This reduced air pressure is communicated through the rear opening 82 of the tube 76 and through the tube 76 to the forward recess 72. An area of reduced pressure is created in the forward recess 72. Bubbles which would form in the tunnel 30 without the combination of the tube 76 and recess 72 are dissipated by the action of the low pressure in the recess 72 and/or sucked into the recess 72. Air is transmitted from the recess 72 through the, tube 76 and through the rear opening 82 to the atmosphere behind the transom 20. A substantially bubble free fall flow of water through the tunnel is thereby provided. As shown in FIG. 1, the outboard motor 14 driving the boat can therefore be mounted higher on the boat with the propeller acting on water passing through the tunnel 30 rather than acting on water passing under the boat 10. It has been found that with the tunnel configuration described above, the outboard engine can be moved eight inches (8") upwardly with respect to the bottom of the boat. A boat which requires fifteen inches (15") of draft with the outboard motor down will now only require seven or eight inches (7 or 8") of draft. A significant improved in shallow water characteristics is thereby provided. Moreover, this is accomplished without any significant diminishment of operating characteristics. The boat top speed remains substantially the same, stability in turns moving forward and moving in reverse also apparently remains the same.

As described above, the overall length of the tunnel 30 is about 26 inches on a boat which has an overall length of between 16 and 18 feet. Thus, the tunnel length is less than twenty percent (20%) of the overall length of the boat and the tunnel volume is very small resulting in only minimal loss of buoyance.

Visual inspection of water issuing from the tunnel during high speed operation has shown substantially bubble-free water when the vent tube 76 is open as compared to substantially bubbled water when the vent tube 72 is blocked.

The invention has been described with reference to a preferred embodiment. Obviously, modifications and alterations will occur to others upon the reading and understanding of this specification. For instance, minor modifications in the dimensions of the tunnel or surface characteristics of the tunnel walls could be made to accommodate different hull shapes and the advantages of the invention still achieved. It is intended to include all such modifications and others and other alterations insofar as they come within the scope of the appended claims for equivalents thereof.

Having thus described the invention, it is so claimed:

1. An improvement in a boat adapted for use with an outboard motor, said boat having a bow, a stern, a bottom, a transom, and a length from said bow to said stern; the improvement comprising:

a tunnel adjacent said transom, said tunnel having a front, a back, a top wall, a right side wall and a left side wall, said tunnel being open at said back adjacent said transom; and, a vent communicating with the front of said tunnel and said transom;

said tunnel having a generally open bottom except adjacent said tunnel front, said tunnel having a closed bottom adjacent said tunnel front whereby a tunnel front recess is defined, said recess having an open rear end and said vent communicating with said recess.

2. The improvement of claim 1, wherein said tunnel has a generally flat top wall and generally flat side walls, said side wall diverging from one another toward said bottom and said top wall diverging from said boat bottom toward said stem.

3. The improvement of claim 2 wherein said vent is a tube communicating with said tunnel front and said transom.

4. The improvement of claim 3 wherein said tube has a semicircular cross-section.

5. The improvement of claim 4, wherein said tunnel has a length less than twenty percent (20%) of said boat length.

6. The improvement of claim 5, wherein said tunnel has a volume less than one cubic foot.

7. The improvement of claim 6, wherein said tunnel is less than thirty inches (30") long.

8. The improvement of claim 5, wherein said tunnel comprises a flat planar top wall and two flat planar side walls.

9. An improvement in a boat adapted for use with an outboard motor, said boat having a bow, a stern, a bottom, a transom, a water line, a length from said bow to said stem, and a centerline from said bow to said stem; the improvement comprising:

a tunnel having a center line generally coincident with said boat center line, said tunnel being wedge shaped having a shallow forward end and a deep rearward end adjacent said transom, said tunnel having an open rear and a bottom open over most of its length, said tunnel bottom being closed at its forward end defining a forward recess having an open rear, said recess being closed except for its open rear; and, a vent tube communicating with said recess and a portion of said boat above said center line.

10. The improvement of claim 9, wherein said tunnel has a length and said length is less than twenty percent (20%) of said boat length.

11. The improvement of claim 9, wherein said tunnel has a top wall, a left side wall having an upper edge, and a right side wall having an upper edge, said right side wall and said left side wall joining said top wall at said upper edges, said side wall diverging away from one another in a downward direction.

12. The improvement of claim 9, wherein said vent tube communicates with a portion of said transom.

13. The improvement of claim 12, wherein said vent tube has a semicircular cross-section.

14. An improvement in a boat adapted for use with an outboard motor, said boat having a bow, a stem, a bottom, a transom, and a length from said bow to said stern; the improvement comprising:

a tunnel adjacent said transom, said tunnel having a front, a back, a generally flat top wall, a generally flat right side wall and a generally flat left side wall, said side wall diverging from one another toward said bottom and said top wall diverging from said boat bottom toward said stern, said tunnel being open at said back adjacent said transom; and a vent communicating with the front of said tunnel, said vent evacuating air from said tunnel;

said tunnel having a generally open bottom except adjacent said tunnel front, said tunnel having a closed bottom adjacent said tunnel front whereby a tunnel front recess is defined said recess having an open rear end and said vent communicating with said recess; and, said vent being a tube having a semicircular cross-section communicating with said tunnel front and said transom.

15. The improvement of claim 14 wherein said vent communicates between said front of said tunnel and said transom.

16. The improvement of claim 14, wherein said tunnel has a length less than twenty percent (20%) of said boat length.

17. The improvement of claim 14, wherein said tunnel has a volume less than one cubic foot.

18. The improvement of claim 17, wherein said tunnel is less than thirty inches (30") long.

19. The improvement of claim 16, wherein said tunnel comprises a flat planar top wall and two flat planar side walls.

20. An improvement in a boat adapted for use with an outboard motor, said boat having a bow, a stem, a bottom, a transom, a water line, a length from said bow to said stem, and a centerline from said bow to said stem; the improvement comprising:

a tunnel having a center line generally coincident with said boat center line, said tunnel being wedge shaped having a shallow forward end and a deep rearward end adjacent said transom, said tunnel having an open rear and a bottom open over most of its length, said tunnel bottom being closed at its forward end defining a forward recess having a rear, said recess being open at its rear; and, a vent tube having a semi-circular cross section communicating with said recess and a portion of said transom of said boat above said center line.

21. The improvement of claim 20, wherein said tunnel has a length and said length is less than twenty percent (20%) of said boat length.

22. The improvement of claim 20, wherein said tunnel has a top wall, a left side wall having an upper edge, and a right side wall having an upper edge, said right side wall and said left side wall joining said top wall at said upper edges, said side wall diverging away from one another in a downward direction.

* * * * *